US008491163B2

(12) United States Patent
Higuchi et al.

(10) Patent No.: US 8,491,163 B2
(45) Date of Patent: Jul. 23, 2013

(54) LIGHTING APPARATUS

(75) Inventors: Kazunari Higuchi, Yokosuka (JP); Takayoshi Moriyama, Yokosuka (JP); Yutaka Honda, Yokosuka (JP); Kenji Nezu, Yokosuka (JP); Shinichi Kumashiro, Yokosuka (JP)

(73) Assignees: Toshiba Lighting & Technology Corporation, Kanagawa (JP); Kabushiki Kaisha Toshiba, Tokyo (JP)

( * ) Notice: Subject to any disclaimer, the term of this patent is extended or adjusted under 35 U.S.C. 154(b) by 320 days.

(21) Appl. No.: 12/885,030

(22) Filed: Sep. 17, 2010

(65) Prior Publication Data

US 2011/0075427 A1 Mar. 31, 2011

(30) Foreign Application Priority Data

Sep. 25, 2009 (JP) ..... 2009-220143
Dec. 22, 2009 (JP) ..... 2009-290147
Dec. 22, 2009 (JP) ..... 2009-290148

(51) Int. Cl.
*F21V 29/00* (2006.01)

(52) U.S. Cl.
USPC ..... 362/294; 257/712; 362/249.02; 362/345; 362/373

(58) Field of Classification Search
USPC ..... 362/249.02, 294, 345, 373, 547; 257/712
See application file for complete search history.

(56) References Cited

U.S. PATENT DOCUMENTS 3,539,801 A 11/1970 Bobrick
4,254,453 A 3/1981 Mouyard
4,400,673 A 8/1983 Gilman
4,641,222 A 2/1987 Derfiny
5,400,229 A 3/1995 Lin
5,519,596 A 5/1996 Woolverton
5,767,576 A 6/1998 Kobayashi et al.
6,367,949 B1 4/2002 Pederson
6,422,716 B2 7/2002 Henrici
6,498,708 B2 12/2002 Schilloff
6,552,658 B1 4/2003 Roller
6,659,627 B2 12/2003 Caluori
6,840,654 B2 1/2005 Guerrieri
7,018,070 B2 3/2006 McCoy
7,207,695 B2 4/2007 Coushaine
7,217,008 B2 5/2007 Thompson
7,281,818 B2 10/2007 You
7,357,541 B2 4/2008 Gamache (Continued)

FOREIGN PATENT DOCUMENTS

CN 2639704 9/2004
CN 2665920 12/2004

(Continued)

OTHER PUBLICATIONS

Extended Search Report issued in EP 00177305.9 on Dec. 28, 2010.

(Continued)

*Primary Examiner* — Stephen F Husar
(74) *Attorney, Agent, or Firm* — DLA Piper LLP (US)

(57) ABSTRACT

According to one embodiment, a lighting apparatus includes a main body including a flat thermal conduction surface. The thermal conduction surface contacts a back surface of a board. Light-emitting devices are mounted on a front surface of the board. An optical member is opposed to a peripheral part of the board on the front surface side of the board. The optical member is fastened to the main body by fastening members, to push the peripheral part of the board against the heat conduction surface of the main body.

9 Claims, 15 Drawing Sheets

U.S. PATENT DOCUMENTS

| | | | |
|---|---|---|---|
| 7,549,772 | B2 | 6/2009 | Wang |
| 7,722,227 | B2 | 5/2010 | Zhang |
| 7,806,562 | B2 | 10/2010 | Behr |
| 7,824,077 | B2 | 11/2010 | Chen |
| 7,845,829 | B2 | 12/2010 | Shaner |
| 7,914,162 | B1 | 3/2011 | Huang |
| 7,918,591 | B2 | 4/2011 | Lynch |
| 7,932,909 | B2 | 4/2011 | Niles et al. |
| 2003/0156416 | A1 | 8/2003 | Stopa |
| 2004/0014338 | A1 | 1/2004 | Takai et al. |
| 2005/0128744 | A1 | 6/2005 | You |
| 2006/0062127 | A1 | 3/2006 | Burghardt |
| 2007/0109796 | A1 | 5/2007 | Johnson |
| 2007/0223218 | A1 | 9/2007 | You et al. |
| 2008/0007955 | A1 | 1/2008 | Li |
| 2008/0025028 | A1 | 1/2008 | Gloisten et al. |
| 2008/0084701 | A1 | 4/2008 | Van de Ven |
| 2008/0273341 | A1 | 11/2008 | Wilcox |
| 2008/0278955 | A1 | 11/2008 | Boyer |
| 2009/0021931 | A1 | 1/2009 | Mayer |
| 2009/0097249 | A1 | 4/2009 | Lee |
| 2009/0231849 | A1 | 9/2009 | Tseng |
| 2009/0244894 | A1 | 10/2009 | Zhou |
| 2009/0257224 | A1 | 10/2009 | Huang |
| 2009/0284972 | A1 | 11/2009 | Chang |
| 2009/0290345 | A1 | 11/2009 | Shaner |
| 2010/0038657 | A1 | 2/2010 | Higuchi |
| 2010/0118541 | A1 | 5/2010 | Li |
| 2010/0214790 | A1 | 8/2010 | Wu |
| 2010/0259919 | A1 | 10/2010 | Khazi |
| 2011/0075411 | A1 | 3/2011 | Van De Ven |
| 2011/0096556 | A1 | 4/2011 | Alexander |

FOREIGN PATENT DOCUMENTS

| | | |
|---|---|---|
| CN | 1921231 | 2/2007 |
| CN | 201072101 | 6/2008 |
| CN | 201096295 | 8/2008 |
| CN | 101295649 | 10/2008 |
| CN | 201310832 | 9/2009 |
| DE | 197 21 061 | 11/1997 |
| DE | 10 2004 028211 | 12/2005 |
| EP | 1030099 | 8/2000 |
| EP | 1767967 | 3/2007 |
| EP | 1772668 | 4/2007 |
| EP | 1950 491 | 7/2008 |
| EP | 2163809 | 3/2010 |
| EP | 2 177 825 | 4/2010 |
| EP | 2 180 241 | 4/2010 |
| JP | 11-273446 | 10/1999 |
| JP | 2001-313260 | 11/2001 |
| JP | 2005-228581 | 8/2005 |
| JP | 2006-172895 | 6/2006 |
| JP | 2006-185602 | 7/2006 |
| JP | 2006-228932 | 8/2006 |
| JP | 2006-260986 | 9/2006 |
| JP | 2008-159455 | 7/2008 |
| JP | 2009-064636 | 3/2009 |
| JP | 2009-64637 | 3/2009 |
| JP | 2009-170126 | 7/2009 |
| WO | WO 2007/028397 | 3/2007 |

OTHER PUBLICATIONS

Chinese Office Action issued in CN Appl. No. 2010110800539310 on Nov. 11, 2010.
English Language Translation of Chinese Office Action issued in CN Appl. No. 2010110800539310 on Nov. 11, 2010.
English Language Abstract of CN 2665920 published Dec. 22, 2004.
European Search Report issued in EP Appln. 09007089.7 on Jan. 18, 2011.
English Language Abstract of DE 10 2004 028211 published Dec. 29, 2005.
English Language Abstract of DE 197 21 061 published Nov. 27, 1997.
Chinese Office Action issued in CN200910223690.6 on dated Jan. 19, 2011.
English Translation of Chinese Office Action issued in CN200910223690.6 on dated Jan. 19, 2011.
English Language Abstract of CN 201072101 published Jun. 11, 2008.
English Language Abstract of CN 1921231 Published Feb. 28, 2007.
English Language Abstract of CN 2639704 sublished Sep. 8, 2004.
U.S. Appl. No. 12/624,958.
English language abstract of JP 2006-172895, published Jun. 29, 2006.
Machine English language translation of JP 2006-172895, published Jun. 29, 2006.
English Abstract of JP-2006-228932 published Aug. 31, 2006.
Machine English language translation of JP-2006-228932 published Aug. 31, 2006.
European Search issued in EP Appl 09011025.5 on Oct. 22, 2009.
Extended European Search Report mail Mar. 29, 2010 issue in EP Application 09011772.
U.S. Appl. No. 12/548,947.
U.S. Appl. No. 12/559,520.
English Abstract of JP 2009-064637 published Mar. 26, 2009.
Machine English language translation of JP 2009-064637 published Mar. 26, 2009.
EP Search Report issued in EP 0901629 on Jan. 23, 2012.
English Language Abstract of JP 2008-159455 published Jul. 10, 2008.
English Language Translation of JP 2008-159455 published Jul. 10, 2008.
English Language Abstract of JP 2006-260986 published Sep. 28, 2009.
English Language Translation of JP 2006-260986 published Sep. 28, 2009.
English Language Abstract of JP 11-273446 published Oct. 8, 2999.
English Language Translation of JP 11-273446 published Oct. 8, 2999.
English Language Abstract of JP 2005-228581 published Aug. 25, 2005.
English Language Translation of JP 2005-228581 published Aug. 25, 2005.
English Language Abstract of JP 2006-185602 published Jul. 13, 2006.
English Language Translation of JP 2006-185602 published Jul. 13, 2006.
English Language Abstract of JP 2001-313260 published Nov. 9, 2001.
English Language Translation of JP 2001-313260 published Nov. 9, 2001.
U.S. Appl. No. 12/473,447.
Chinese Office Action issued in CN 201010292773.3 on Sep. 7, 2012.
English Language Translation of Chinese Office Action issued in CN 201010292773.3 on Sep. 7, 2012.
English Language Abstract of CN101295649 published Oct. 29, 2008.
English Language Abstract of CN 201096295 published Aug. 6, 2008.
English Language Abstract of CN 201310832 Sep. 16, 2009.
Japanese Office Action issued in JP 2009-220143 on May 7, 2013.
English Language Translation of Japanese Office Action issued in JP 2009-220143 on May 7, 2013.
English Language Abstract of JP 2009-170126 published on Jul. 30, 2009.
English Language Translation of JP 2009-170126 published on Jul. 30, 2009.
English Language Abstract of JP 2009-064636 published on Mar. 26, 2009.
English Language Translation of JP 2009-064636 published on Mar. 26, 2009.

LIGHTING APPARATUS

CROSS-REFERENCE TO RELATED APPLICATIONS

This application is based upon and claims the benefit of priority from Japanese Patent Applications No. 2009-220143, filed Sep. 25, 2009; No. 2009-290147, filed Dec. 22, 2009; and No. 2009-290148, filed Dec. 22, 2009; the entire contents of all of which are incorporated herein by reference.

FIELD

Embodiments described herein relate generally to a lighting apparatus using a light-emitting device such as an LED.

BACKGROUND

In recent years, development of lighting apparatuses using a solid state light-emitting devices such as LEDs and EL devices has been made progress. In lighting apparatuses of this type, when light-emitting devices are heated by lighting, the output of the light-emitting devices decreases by the heat, and the life of the light-emitting devices is shortened. Therefore, measures to suppress increase in temperature of LEDs are taken for lighting apparatuses using, for example, LEDs as light source.

As measures for heat radiation, known are a method of radiating heat of LEDs from the main body side by attaching a board, on which a plurality of LEDs are mounted, in contact with the apparatus main body made of metal, and a method of radiating heat of LEDs through a heat radiation plate by attaching a board, on which the LEDs are mounted, in contact with the heat radiation plate.

However, when LEDs generate heat, the board on which the LEDs are mounted is also heated and expanded by heat. Therefore, when the board is fixed onto a heat radiation member such as the main body and a heat radiation plate, the board may be distorted by thermal stress. Conversely, when the board is not fixed onto the heat radiation member in a state where the whole surface of the board is brought into close contact with the heat radiation member, the heat transmission efficiency decreases, and heat radiation of LEDs cannot be sufficiently performed.

Therefore, sufficient and sure heat radiation measures for light-emitting devices are desired in lighting apparatuses of this type.

DETAILED DESCRIPTION

Figure 1:
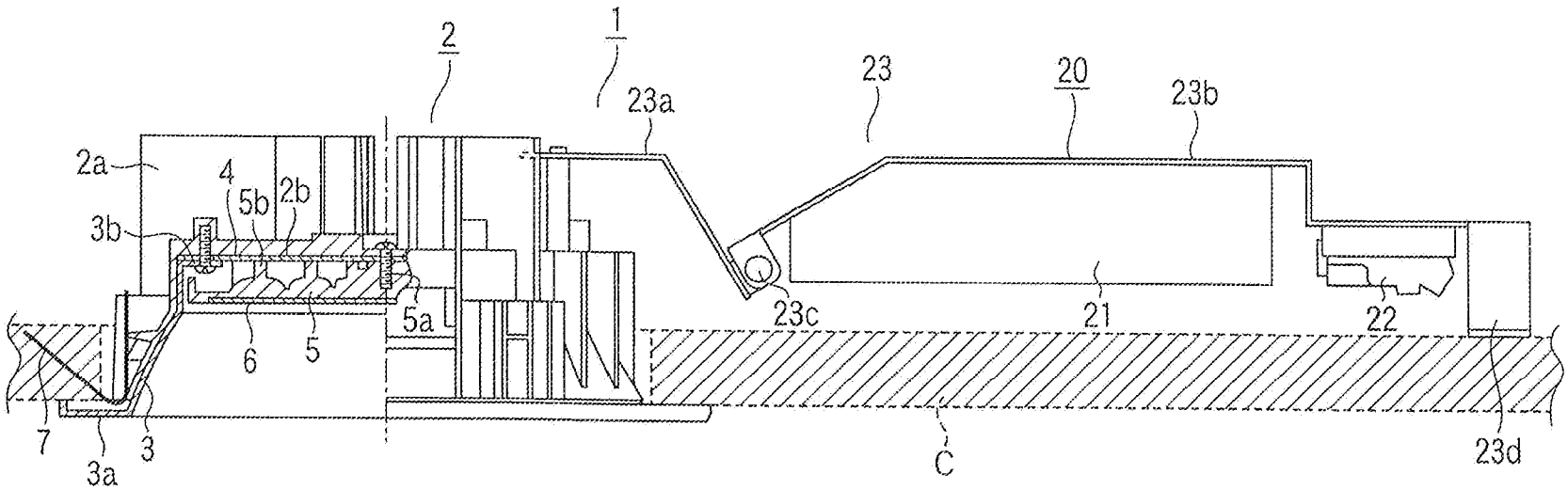
FIG. 1 is a partial cross-sectional view illustrating a downlight according to an embodiment of a lighting apparatus, which is obtained by cutting off a part of the downlight along line C-X of FIG. 4.

Embodiments will now be described in detail below with reference to drawings.

In general, according to one embodiment, a lighting apparatus 1 includes a main body 2 including a flat thermal conduction surface 2*b*. The thermal conduction surface 2*b* contacts a back surface of a board 4. Light-emitting devices 10 are mounted on a front surface of the board 4. An optical member 3 is opposed to a peripheral part of the board 4 on the front surface side of the board 4. The optical member 3 is fastened to the main body 2 by fastening members 8, to push the peripheral part of the board 4 against the heat conduction surface 2*b* of the main body 2.

FIG. 1 is a schematic diagram of a downlight 1, as an example of the lighting apparatus. The downlight 1 comprises an apparatus main body 2 (hereinafter simply referred to as "main body 2"), and a power supply unit 20 connected to the main body 2. The main body 2 is attached to a ceiling wall C indicated by broken lines in FIG. 1, and the power supply unit 20 is attached onto the back side of the ceiling wall C, that is, in the roof space.

In the following explanation, the direction going toward the room from the ceiling wall C is referred to as "downward", and the direction going toward the roof space from the ceiling wall C is referred to as "upward". With respect to the members, the lower side in FIG. 1 is referred to as "front surface side" or "lower side", and the upper side in FIG. 1 is referred to as "back surface side" or "upper side".

As illustrated in FIG. 1, the power supply unit 20 includes a power supply circuit 21, a power supply terminal holder 22, and an arm member 23. The arm member 23 includes a fixing part 23*a*, at one end of which the main body 2 is fixed by screws or the like (not shown), and an attaching part 23*b*, one end of which is rotatably connected to the other end of the fixing part 23*a* through a hinge 23*c*. The power supply circuit 21 including a power supply circuit board (not shown) is attached to a lower surface of the attaching part 23*b*.

A number of electronic parts such as a control IC, a transformer, and a capacitor, are mounted on the power supply circuit board. In addition, the power supply circuit board is electrically connected to the board 4 (described below) incorporated into the main body 2. Specifically, a plurality of LEDs 10 (described below) mounted on the board 4 are controlled and lit by the power supply circuit 21 of the power supply circuit board.

In addition, the power supply terminal holder 22 is attached to the lower surface of the other end of the attaching part 23*b*, to which the power supply circuit 21 is attached. The power supply terminal holder 22 is connected to a commercial power supply, and feeds electricity to the power supply circuit 21. Besides, a support leg 23*d* is provided on the lower surface of the other end of the attaching part 23*b*, which is more distant from the main body 2 than the power supply terminal holder 22 is.

In addition, when the downlight 1 is attached to the ceiling wall C, the power supply unit 20 is inserted from the room side through an attaching hole of the ceiling wall C. The main body 2 which is connected to the power supply unit 20 by the arm member 23 includes a decorative frame 3*a* (described later) which has a diameter larger than a diameter of the attaching hole of the ceiling wall C. Therefore, the decorative frame 3*a* on the front surface side of the main body 2 cannot pass through the attaching hole. Thus, when the downlight 1 is attached, the decorative frame 3*a* is caught on the front surface side of the ceiling wall C.

At this time, the main body 2 is fixed onto the ceiling wall C by elastic force of a leaf spring 7 described later. In addition, the support leg 23*d* attached to an end portion of the arm member 23, which is most distant from the main body 2, abuts against the back surface of the ceiling wall C, and supports the other end of the arm member 23. As described above, the downlight 1 is attached to the ceiling wall C.

The following is explanation of the main body 2 of the downlight 1 and members attached to the main body 2.

The main body 2 is formed in an almost cylindrical shape, by die casting using aluminum alloy having good thermal conductivity. The main body 2 is provided with the light distribution member 3 (optical member), the board 4, a reflector 5, a light-transmitting cover 6, and three leaf springs 7. The three leaf springs 7 are arranged along the outer circumference of the main body 2 and apart from one another at almost equal intervals, and function to fix the main body 2 to the attaching hole of the ceiling wall C by elastic force thereof.

Figure 2:
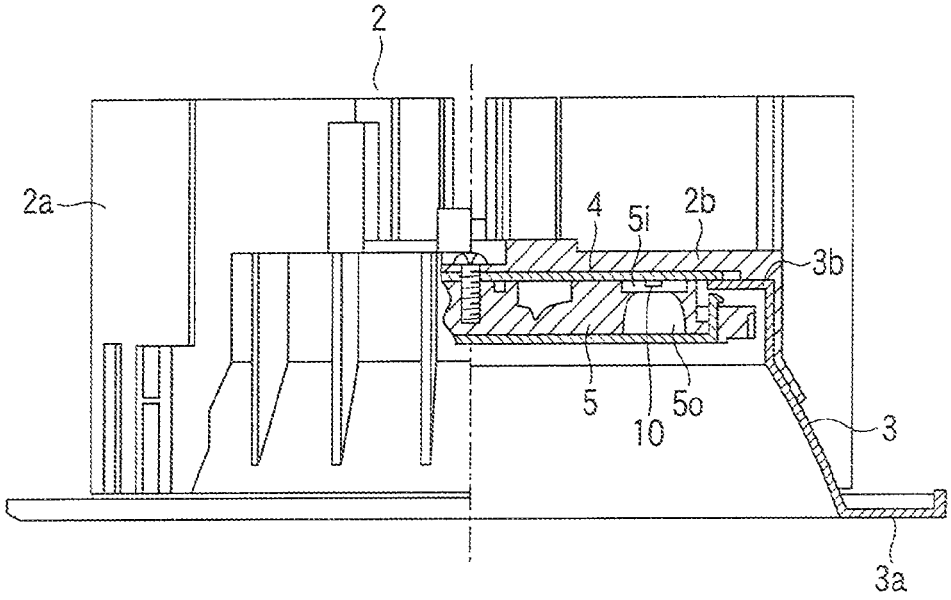
FIG. 2 is a partial cross-sectional view illustrating the downlight of FIG. 1, which is obtained by cutting off part of the downlight along line C-Y of FIG. 4.
Figure 3:
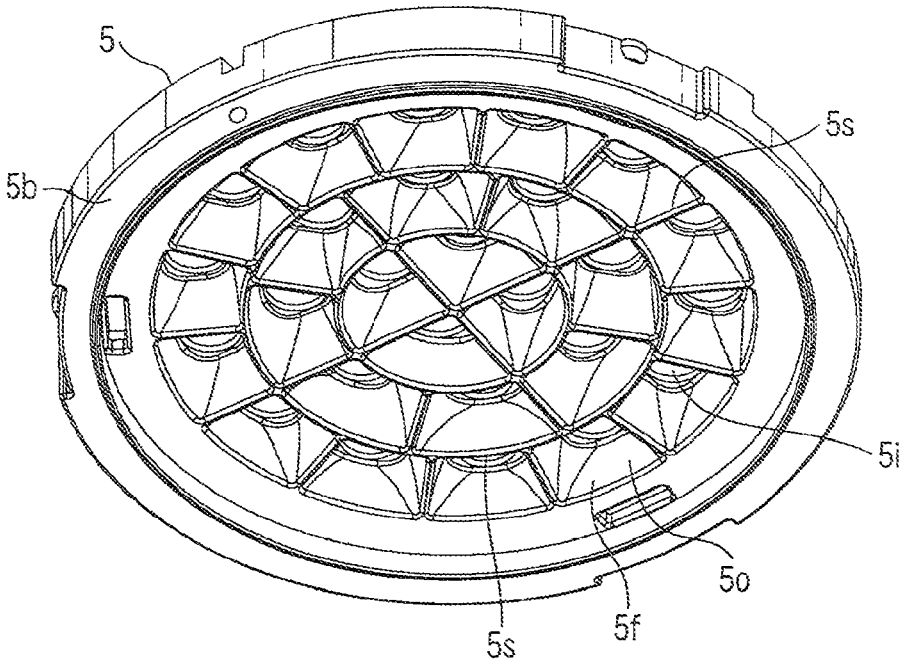
FIG. 3 is an external cross-sectional view of a reflector of the downlight of FIG. 1, as viewed from an inclined downside position.
Figure 4:
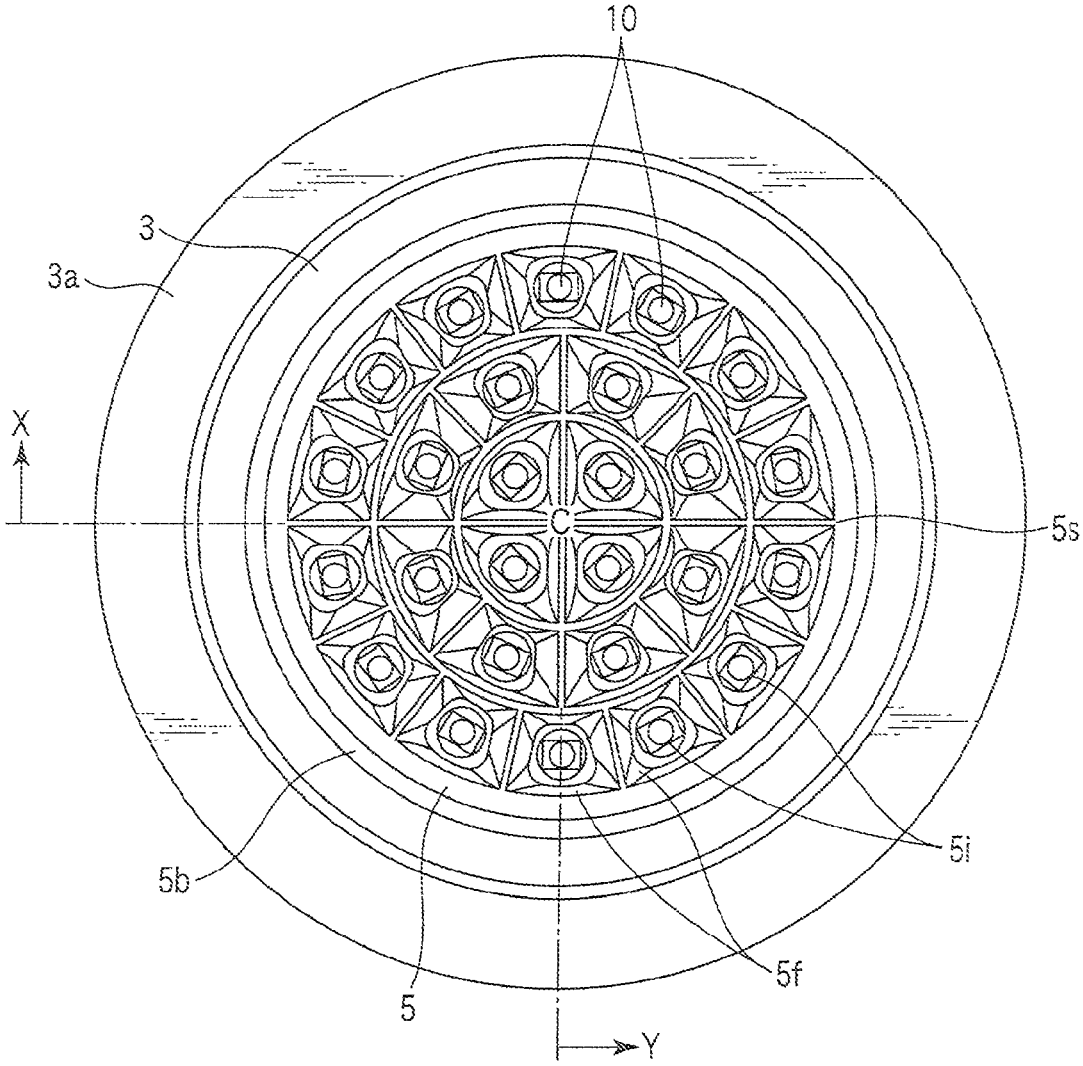
FIG. 4 is a bottom view of the downlight of FIG. 1, as viewed from a position directly under the downlight.
Figure 5:
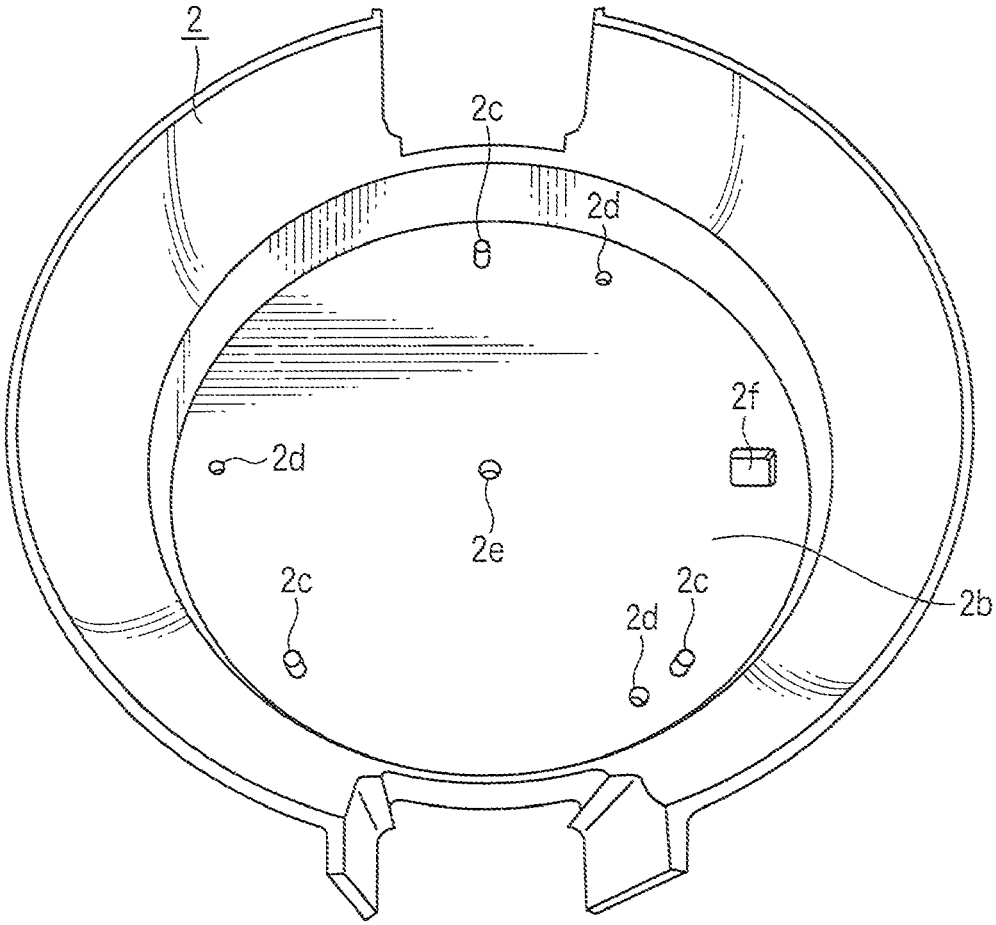
FIG. 5 is an external cross-sectional view of a main body of the downlight of FIG. 1, as viewed from an inclined downside position.
Figure 6:
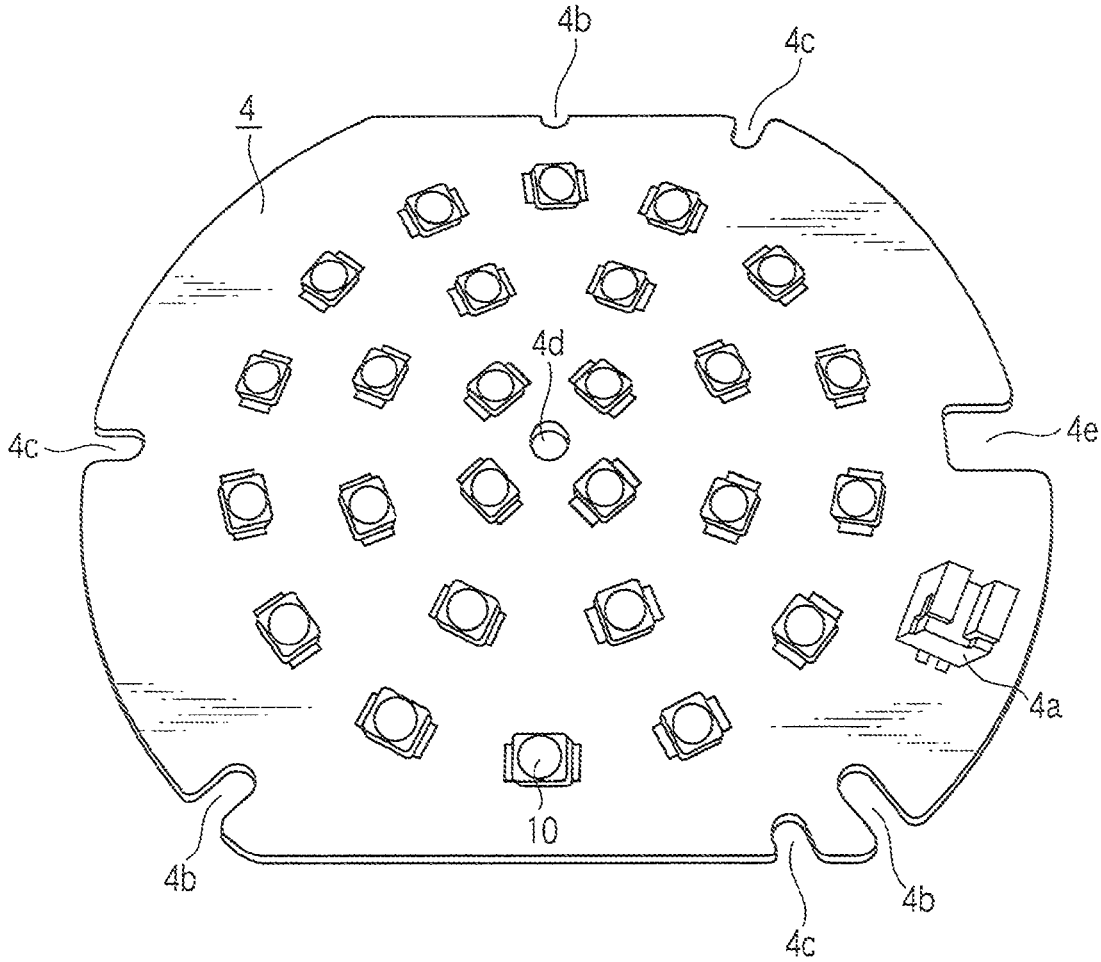
FIG. 6 is an external cross-sectional view of a board of the downlight of FIG. 1, as viewed from an inclined downside position.
Figure 7:
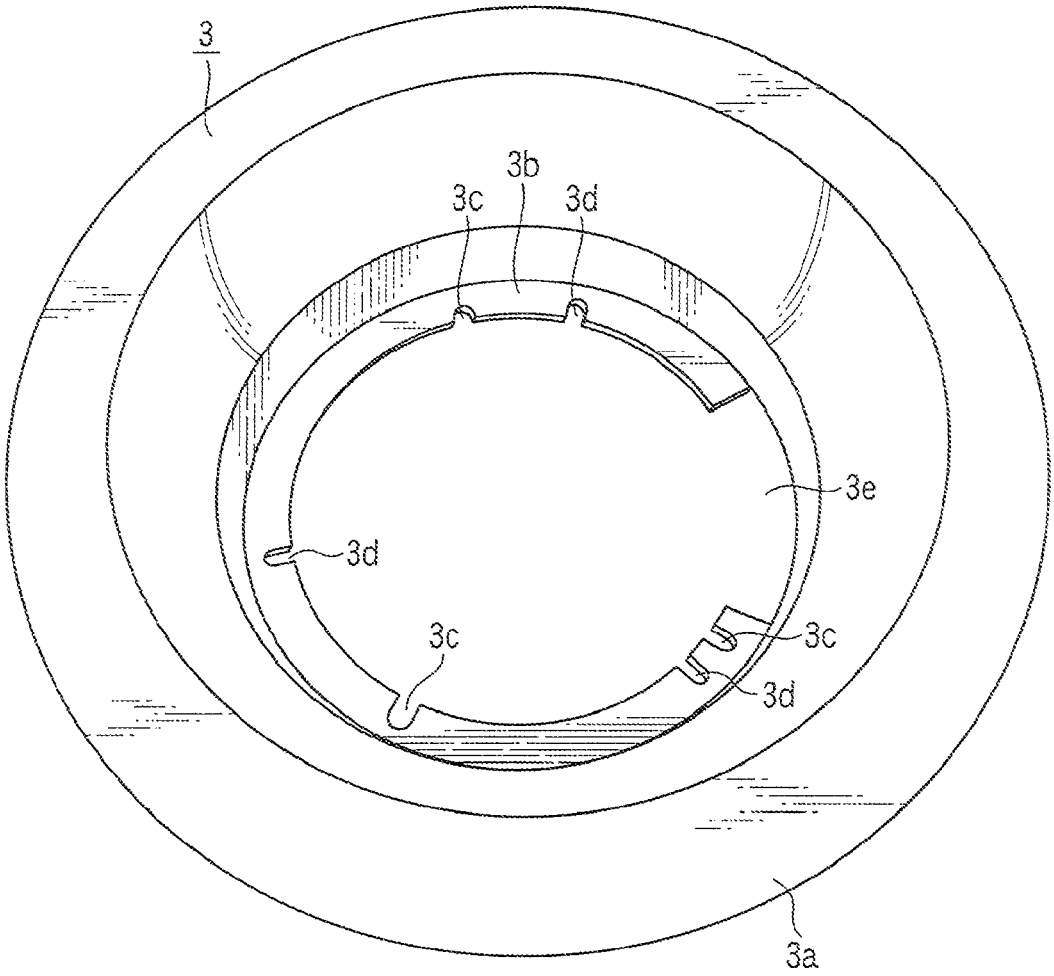
FIG. 7 is an external cross-sectional view of a light distribution member of the downlight of FIG. 1, as viewed from an inclined downside position.

FIG. 3 is an external perspective view of the reflector 5 as viewed from an inclined downside position. FIG. 5 is an external perspective view of the main body 2 as viewed from an inclined downside position. FIG. 6 is an external perspective view of the board 4 as viewed from an inclined downside position. FIG. 7 is an external perspective view of the light distribution member 3 as viewed from an inclined downside position. FIG. 4 is a bottom view of the downlight 1 of FIG. 1 as viewed from a position directly under the downlight 1. FIG. 2 is a partial cross-sectional view of the downlight 1, in which a part of the downlight 1 is cut off along line C-Y of FIG. 4.

The main body 2 has an almost ring-shaped internal surface which is inclined to spread downward toward the outside. In addition, a plurality of heat radiating fins 2*a* extending in the vertical direction are formed on the external surface of the main body 2. The external surface is baking-finished by white melamine resin-based paint. In addition, the main body 2 has the thermal conduction surface 2*b*, which the back surface of the board 4 is brought into close contact with and attached to. The thermal conduction surface 2*b* continues to an edge part of a smaller-diameter side of the internal surface of the main body 2, and extends almost horizontally.

The light distribution member 3 is formed in a cylindrical shape of a metal material having good thermal conductivity, such as an iron plate, and disposed along the internal surface of the main body 2 and a peripheral part of the thermal conduction surface 2*b*. Specifically, the light distribution member 3 also includes an almost ring-shaped inclined part which is inclined to spread downward toward the outside.

In addition, the light distribution member 3 includes a ring-shaped flange 3*a* which extends from a spreading lower end opening edge of the inclined part toward the outside as one unitary piece. The flange 3*a* on the larger-diameter side functions as a decorative frame which is exposed to the room side in a state where the downlight 1 is attached to the ceiling wall C.

The light distribution member 3 also includes an almost ring-shaped flange 3*b* which extends from an upper end opening edge of the smaller-diameter side of the inclined part toward the inside as one unitary piece. The flange 3*b* of the smaller-diameter side is opposed to a part of the thermal conduction surface 2*b* of the main body 2, which is close to the peripheral part of the thermal conduction surface 2*b*. The board 4 is held between the flange 3*b* and the peripheral part of the thermal conduction surface 2*b* of the main body 2. An internal surface of the light distribution member 3 is also baking-finished with white melamine resin-based paint.

The board 4 is formed in an almost circular plate shape, and a plurality of LEDs 10 are mounted on a surface of the board 4. In the present embodiment, four LEDs are mounted around the center of the board 4, eight LEDs are mounted around the four LEDs, and fourteen LEDs are mounted at the outermost, that is, 26 LEDs are mounted in total. The board 4 is attached to the main body 2 in a horizontal position, such that the whole back surface of the board 4 contacts the thermal conduction surface 2*b* of the main body 2.

In addition, an electricity-receiving connector 4*a* which is electrically connected to the LEDs 10 is attached to a part close to the edge part on the front surface side of the board 4 and outside the area in which the LEDs 10 are mounted. The electricity-receiving connector 4 is connected with a power supply connector (not shown) which is attached to a tip of a lead line (not shown) drawn from the power supply unit 20.

The board 4 is formed by superposing an insulating layer on a surface of a base plate formed of metal material such as aluminum, to effectively radiate heat generated by the LEDs 10. Specifically, the board 4 is thermally connected to the main body 2, by being attached to the main body 2 with the metal base plate in contact with the thermal conduction surface 2*b* of the main body 2. As another example, the board 4 may be formed of a ceramic material or a synthetic resin material such as epoxy resin, which have relatively good heat radiation property and have excellent durability.

In the meantime, when the board 4 is held between the thermal conduction surface 2*b* of the main body 2 and the flange 3*b* on the smaller-diameter side of the light distribution member 3, all the LEDs 10 mounted on the surface of the board 4 are surrounded inside the flange 3*b*. In other words, the light distribution member 3 is disposed to surround the board 4. The light distribution member 3 has a function of distributing and controlling light outgoing from the LEDs 10, by the internal surface of the inclined part spreading downward toward the outside. For example, the light distribution member 3 has a function of suppressing glare.

The reflector 5 is formed in an almost circular plate shape by white polycarbonate or ASA resin. The reflector 5 is attached to the board 4 in contact with the front surface side of the board 4. Therefore, the back surface side of the reflector 5, in which the reflector 5 is opposed to the front surface of the board 4, is provided with a plurality of circular openings 5*i* to expose the LEDs 10 to the front surface side.

In correspondence with the circular openings 5*i*, a plurality of an almost bowl-shaped reflection surfaces 5*f* which spread from the respective circular openings 5*i* downward toward the outside are formed on the front surface side, that is, the lower surface side of the reflector 5. In addition, a ring-shaped outer peripheral part 5*b* is formed in a peripheral part on the front surface side of the reflector 5. Specifically, the reflection surfaces 5*f* are formed inside the outer peripheral part 5*b*. In addition, irradiation openings 5*o* of the respective reflection surfaces 5*f*, which are opened to the front surface side of the reflector 5, have an opening diameter larger than a diameter of the circular openings 5*i* located on the back surface side of the reflector 5.

In other words, the reflection surfaces 5*f* provided in correspondence with the LEDs 10 are divided by a plurality of partitions 5*s*, and spread from edges of the circular openings 5*i* downward toward ridgelines of the partitions 5*s* toward the outside. In addition, the reflection surfaces 5*f* function to distribute and control light emitted from the LEDs 10 for each LED 10, and efficiently reflect light from the LEDs 10 as the whole reflector 5.

The cover 6 is disposed in a position inside the outer peripheral part 5*b* of the reflector 5 and covering all the irradiation openings 5*o* on the front surface side of the reflection surfaces 5*f*. The cover 6 is formed of white, semitransparent, or diffusive material. By covering all the irradiation openings 5*o* with the cover 6, light from the LEDs 10 which is efficiently reflected by the reflection surfaces 5*f* of the reflector 5 is diffused, and uniform illumination light is generated. Then, in cooperation with the above light distribution member 3, uniform and good illumination light which is properly distribution-controlled can be applied.

With reference to FIG. 5 to FIG. 7, an attachment structure to attach and position the board 4 and the light distribution member 3 to the main body 2 will now be explained.

As illustrated in FIG. 5, three pin-shaped positioning projections 2*c* are provided in positions close to a peripheral part of the thermal conduction surface 2*b* of the main body 2. These three projections 2*c* function to position the board 4 and the light distribution member 3 with respect to the main body 2, in cooperation with a plurality of cut-away parts 4*b* and 3*c* (described later) of the board 4 and the light distribution member 3, to attach the board 4 and the light distribution member 3 to the main body 2 in determined orientation. The thermal conduction surface 2*b* of the main body 2 is almost circular and flat.

In addition, three screw holes 2*d* to fasten the light distribution member 3 to the main body 2 are formed in positions close to the peripheral part of the thermal conduction surface 2*b* of the main body 2. Besides, a screw hole 2*e* which pierces through the main body 2 to fasten the reflector 5 to the main body 2 is formed in the center part of the thermal conduction surface 2*b*. In addition, a hole 2*f* through which a lead line which connects the board 4 with the power supply unit 20 passes pierces through the main body 2.

The three screw holes 2*d* which are formed in the thermal conduction surface 2*b* of the main body 2 to fasten the light distribution member 3 are formed in positions close to the peripheral part of the thermal conduction surface 2*b* to which the flange 3*b* of the light distribution member 3 is opposed, and apart from one another at almost equal intervals (at just 120° intervals in the present embodiment) along the circumferential direction. On the other hand, the three projections 2*c* are provided in positions shifted from one another in circumferential direction at irregular intervals and close to the peripheral part of the thermal conduction surface 2*b*, to attach the light distribution member 3 and the board 4 in accurate orientation with respect to the thermal conduction surface 2*b*.

As illustrated in FIG. 6, a plurality of cut-away parts 4*b*, 4*c*, and 4*e* opened to the outer edge of the board 4 are formed in the peripheral part of the board 4. In addition, a screw hole 4*d* which pierces through the board 4 to attach the reflector 5 is provided in the center part of the board 4. The center screw hole 4*d* concentrically overlaps the screw hole 2*e* located in the center of the thermal conduction surface 2*b*, when the board 4 is superposed on the thermal conduction surface 2*b* of the main body 2.

Among the cut-away parts of the peripheral part of the board, the three cut-away parts 4*b* function as first receiving part, and are provided in positions in which they can receive the three respective projections 2*c*, when the board 4 is attached in accurate orientation to the thermal conduction surface 2*b* of the main body 2. In other words, the three projections 2*c* of the thermal conduction surface 2*b* and the three cut-away parts 4*b* of the board 4 are arranged in positions which do not agree when the board 4 is to be attached in wrong orientation. Therefore, when the board 4 is to be attached in wrong orientation, the board 4 cannot be attached by functions of the projections 2*c* and the cut-away parts 4*b*.

In addition, the other three cut-away parts 4*c* in the peripheral part of the board 4 are formed in positions where they overlap the respective three screw holes 2*d* of the thermal conduction surface 2*b*, when the board 4 is attached in accurate orientation to the thermal conduction surface 2*b* of the main body 2. In addition, the other cut-away part 4*e* is provided in a position where the hole 2*f* of the thermal conduction surface 2*b* is exposed to the front surface side, when the board 4 is attached in accurate orientation to the thermal conduction surface 2*b* of the main body 2.

As illustrated in FIG. 7, the flange 3*b* of the smaller-diameter side of the light distribution member 3 is also provided with a plurality of cut-away parts 3*c*, 3*d* and 3*e* opened to the inner edge. The cut-away parts 3*c*, 3*d* and 3*e* are also formed in positions where they overlap the projections 2*c*, the screw holes 2*d*, and the hole 2*f* of the thermal conduction surface 2*b*, respectively, and overlap the cut-away parts 4*b*, 4*c*, and 4*e* of the board 4, respectively, when the light distribution member 3 is attached to the main body 2 such that the board 4 disposed in accurate orientation to the thermal conduction surface 2*b* of the main body 2 is held between the light distribution member 3 and the thermal conduction surface 2*b*.

For example, the three cut-away parts 3*c* of the flange 3*b* function as second receiving parts, and are formed in positions where they overlap the three respective cut-away parts 4*b* of the board 4, and can receive the three respective projections 2*c* of the thermal conduction surface 2*b*. In addition, the three cut-away parts 3*d* are formed in positions where they overlap the three respective cut-away parts 4*c* of the board 4, and overlap the three respective screw holes 2*d* of the thermal conduction surface 2*b*. Besides, the other cut-away part 3*e* is provided to release the electricity-receiving connector 4*a* to prevent interference with the electricity-receiving connector 4*a* attached to the front surface of the board 4, and release the lead line (not shown) which goes through the hole 2*f* of the thermal conduction surface 2*b* and the cut-away part 4*e* of the board 4 and is connected to the electricity-receiving connector 4*a* through a power feeding connector (not shown).

Figure 8:
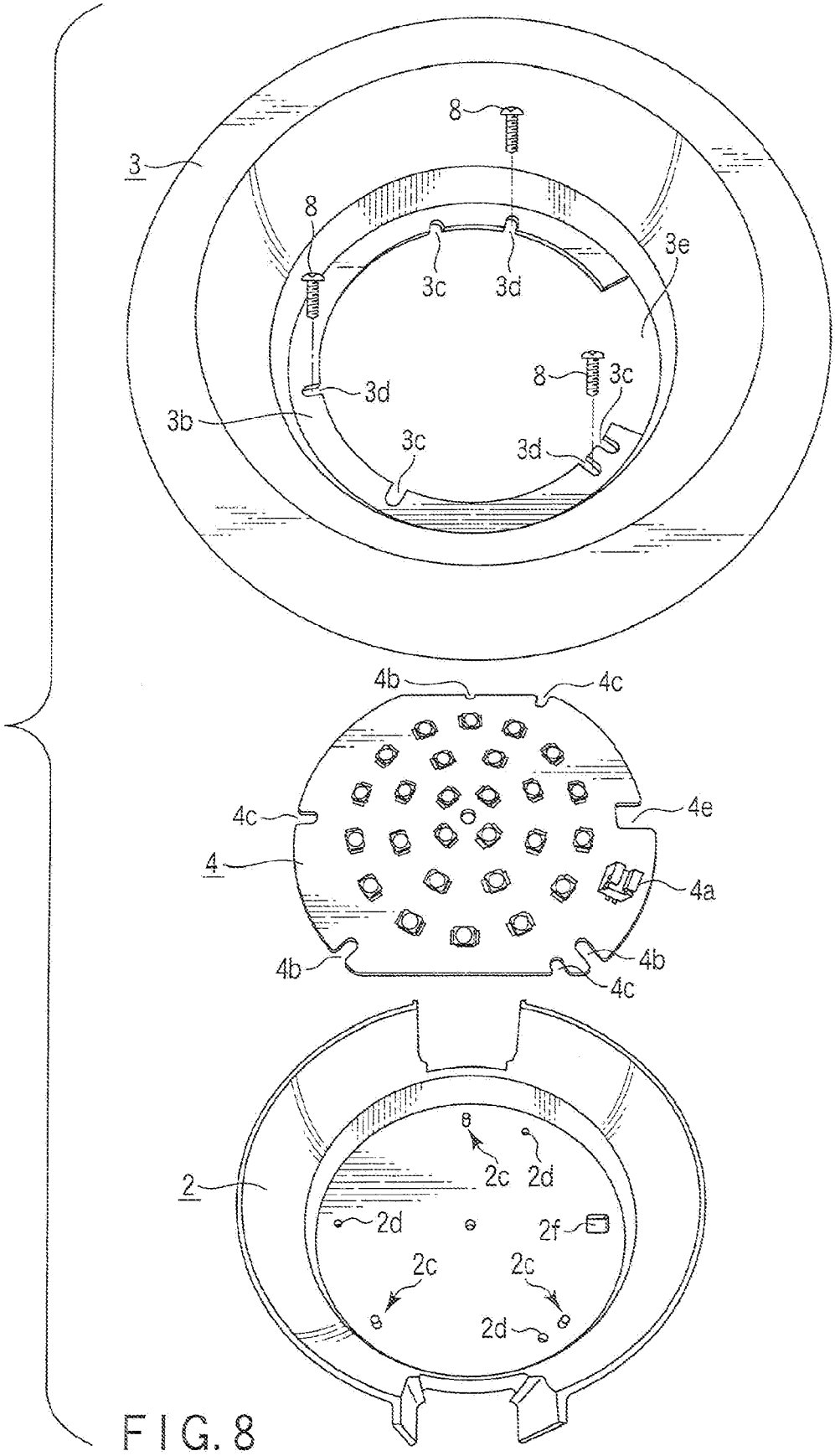
FIG. 8 is an exploded perspective view of the downlight of FIG. 1.
Figure 9:
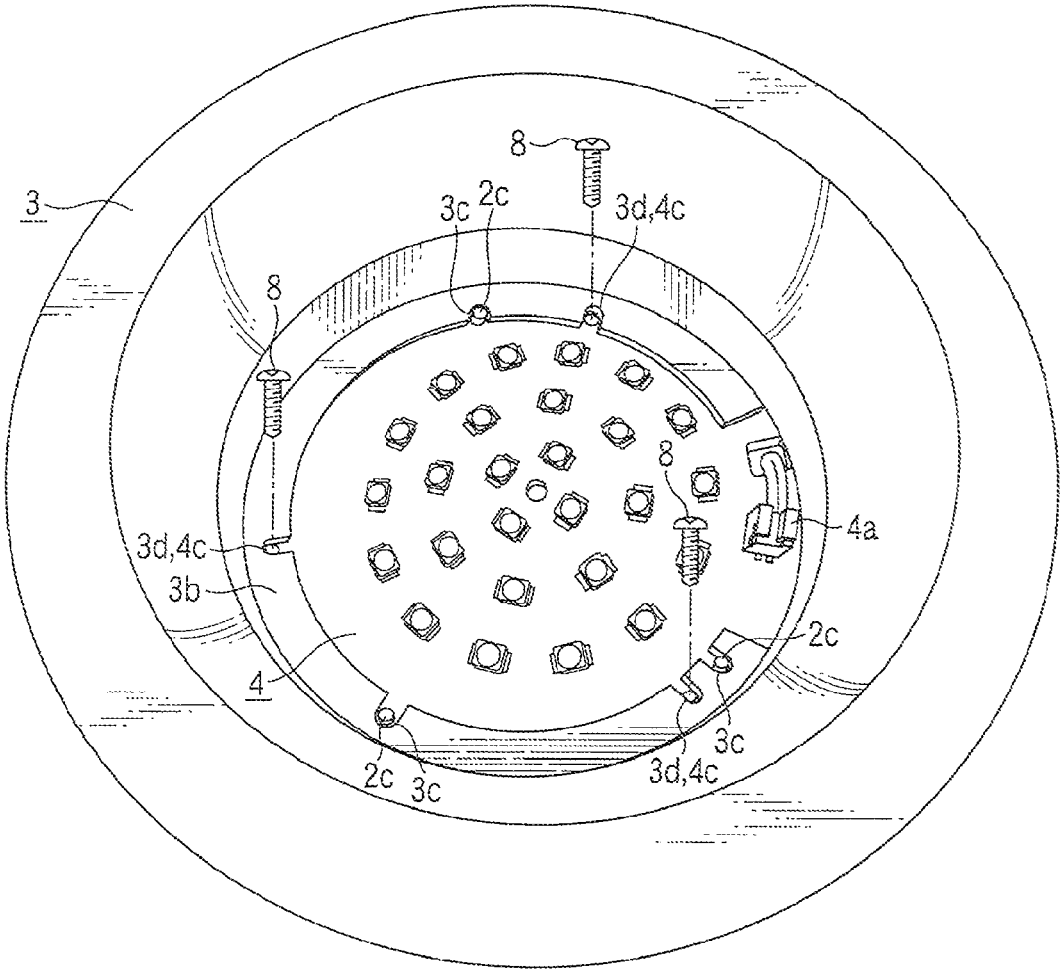
FIG. 9 is an external perspective view for explaining operation of attaching the light distribution member of FIG. 7.
Figure 10:
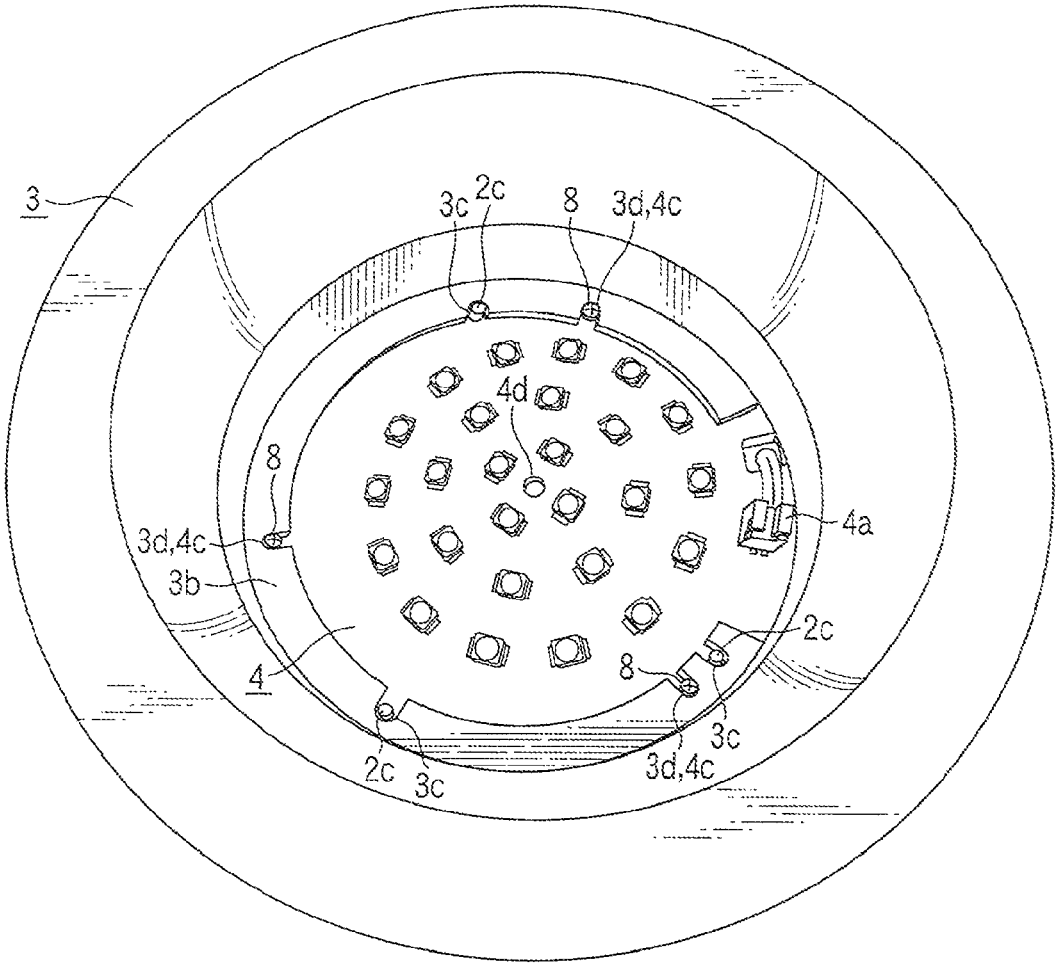
FIG. 10 is an external perspective view illustrating a state in which the light distribution member of FIG. 7 is attached.

Next, a method of attaching the board 4 and the light distribution member 3 to the main body 2 is explained, mainly with reference to FIG. 8 to FIG. 10.

FIG. 8 is an exploded perspective view of the main body 2, the light distribution member 3, and the board 4, as structure of the main part of the downlight 1. FIG. 9 is an external perspective view for explaining operation of attaching the light distribution member 3 and the board 4 to the main body 2. FIG. 10 is an external perspective view illustrating a state in which the light distribution member 3 is attached to the main body 2 to hold the board 4 between the main body 2 and the light distribution member 3.

First, the board 4 is attached to the thermal conduction surface 2*b* of the main body 2. When the board 4 is attached, the orientation of the board 4 is determined, with the three projections 2*c* projecting from the thermal conduction surface 2*b* used as guide. Specifically, the board 4 is disposed on the thermal conduction surface 2*b*, in an orientation in which the three projections 2*c* are inserted into the three respective cut-away parts 4*b* of the board 4. In this state, the board 4 is slightly movably held with clearance gap in the surface direction thereof.

Thereby, the back surface of the board 4 contacts the flat thermal conduction surface 2*b*. In addition, thereby, the three cut-away parts 4*c* of the board 4 are opposed to the three screw holes 2*d* of the thermal conduction surface 2*b* of the main body 2, and the cut-away part 4*e* of the board 4 is opposed to the hole 2*f* of the thermal conduction surface 2*b*. As a matter of course, the screw hole 4*d* in the center part of the board 4 also overlaps the screw hole 2*e* in the center part of the thermal conduction surface 2*b*.

Next, the light distribution member 3 is attached to the main body 2, to hold a part close to the peripheral edge part of the board 4 between the thermal conduction surface 2*b* and the flange 3*b*. In the same manner as the board 4, the light distribution member 3 is attached to the main body 2 in accurate orientation, with the three projections 2*c* on the main body 2 side used as guides. Specifically, the light distribution member 3 is superposed on the front surface side of the board 4, in an orientation in which the three projections 2*c* are inserted into the three respective cut-away parts 3*c* formed in the flange 3*b* of the light distribution member 3.

Thereby, the upper surface of the flange 3*b* contacts the peripheral edge part on the front surface side of the board 4. Thereby, the three cut-away parts 3*d* of the flange 3*b* are opposed to the three cut-away parts 4*c* of the board 4. In addition, the cut-away part 3*e* of the flange 3*b* is disposed in a position of releasing the electricity-receiving connector 4*a* and peripheral members mounted on the front surface of the board 4.

Specifically, the three projections 2*c* projecting from the thermal conduction surface 2*b* of the main body 2, the three cut-away parts 4*b* formed in the peripheral part of the board 4, and the cut-away parts 3*c* formed in the flange 3*b* of the light distribution member 3 function as positioning means for positioning and attaching the board 4 and the light distribution member 3 to the main body 2. In other words, the projections and the cut-away parts function as means for preventing erroneous attachment of the board 4 and the light distribution member 3, and facilitate operation of attaching the board 4 and the light distribution member 3.

In particular, since the three projections 2*c* of the thermal conduction surface 2*b* of the main body 2 simultaneously have a function of positioning the board 4 and a function of positioning the light distribution member 3, it is possible to reduce the number of positioning parts for that. The three projections 2*c* also function as positioning guides when the reflector 5 is attached to the front surface side of the board 4. Specifically, the reflector 5 is also provided with positioning holes (not shown) which receive distal ends of the three respective projections 2*c*.

As described above, after the board 4 and the light distribution member 3 are positioned on the thermal conduction surface 2*b* of the main body 2, three attaching screws 8 (fastening members) are inserted from the front surface side of the light distribution member 3 through the cut-away parts 3*c* of the flange 3*b* and the cut-away parts 4*b* of the board 4, and fitted into the three screw holes 2*d* formed in the thermal conduction surface 2*b* of the main body 2, as illustrated in FIG. 9.

Then, as illustrated in FIG. 10, by fitting and fastening the three attaching screws 8 into the main body 2, the light distribution member 3 is fastened and fixed to the main body 2, and simultaneously the peripheral part of the board 2 is held between the thermal conduction surface 2*b* and the flange 3*b*. In particular, in this case, the fastening force of each attaching screw 8 serves as force of pushing the back surface of the board 4 against the thermal conduction surface 2*b* of the main body 2, in a plurality of positions (in three positions in the present embodiment) along the peripheral part of the board 4.

Figure 11:
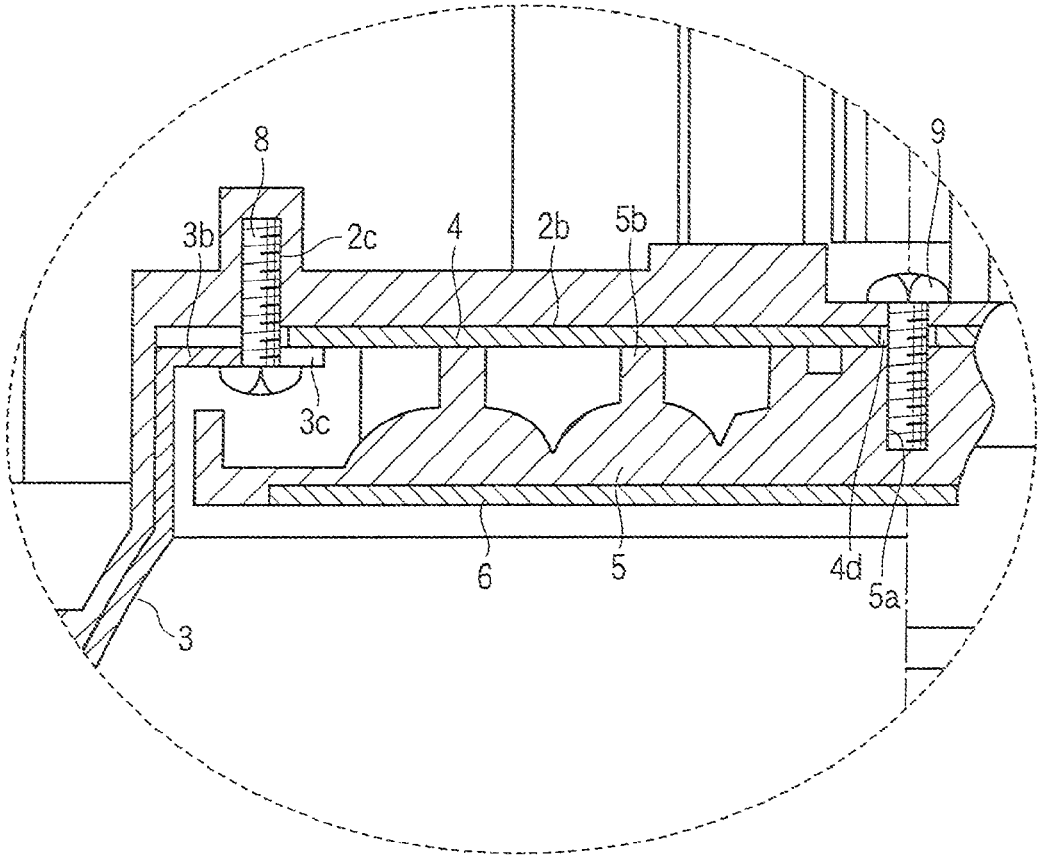
FIG. 11 is a partial enlarged cross-sectional view in which a part in which the light distribution member of FIG. 7 is fixed to the main body of FIG. 5 and therearound are enlarged.
Figure 12:
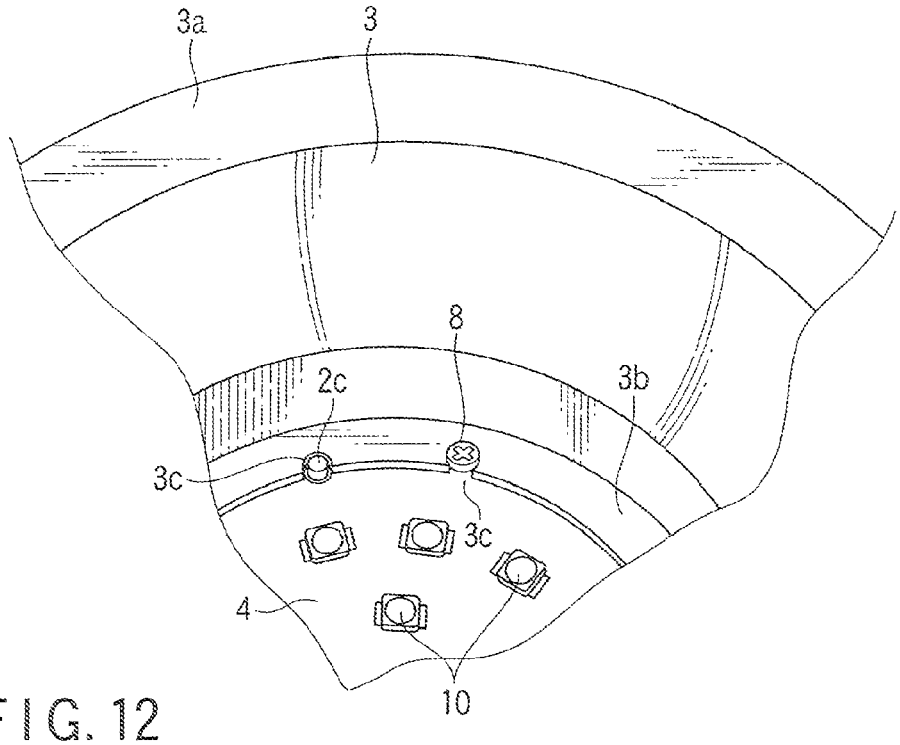
FIG. 12 is a partial enlarged perspective view of an attaching screw and a projection of FIG. 10.

FIG. 11 is a cross-sectional view of a state in which the peripheral part of the board 4 is held between the flange 3*b* of the light distribution member 3 and the thermal conduction surface 2*b* of the main body 2 by fastening the attaching screws 8. In addition, FIG. 12 is a partially enlarged external diagram of one attaching screw 8 together with one projection 2*c*, as viewed from an inclined downside position. The drawings show that part of the board 4 close to the peripheral part is pushed against, the thermal conduction surface 2*b* of the main body 2, and the back surface of the board 4 is brought into close contact with the thermal conduction surface 2*b*, by fastening the attaching screws 8.

As described above, adopting a structure of fastening the light distributing member 3 to the main body 2 by the attaching screws 8, with the peripheral part of the board 4 held therebetween, makes dedicated screws to attach the board 4 to the thermal conduction surface 2*b* of the main body 2 unnecessary, and reduces the number of parts. In addition, it is possible to reduce workloads to fix the board 4, and reduce the manufacturing cost of the downlight 1 for that.

As described above, when the light distribution member 3 is fastened to the main body 2 with the peripheral part of the board 4 held between the flange 3*b* of the light distribution member 3 and the thermal conduction surface 2*b* of the main body 2, part of the board 4 close to the peripheral part thereof can be effectively pushed against and brought into close contact with the thermal conduction surface 2*b*, and heat of the board 4 can be efficiently conducted to the thermal conduction surface 2*b* through the peripheral part.

In the present embodiment, the shape of the light distribution member 3 is designed such that the flange 3*b* of the light distribution member 3 can be strongly pushed against the peripheral part of the front surface of the board 4 by fastening the three attaching screws 8. Specifically, the light distribution member 3 is designed such that space is formed between the external surface of the inclined part of the light distribution member 3 and the internal surface of the main body 2, in a state where the light distribution member 3 is fastened to the main body 2, as illustrated in FIG. 10 to FIG. 12. In other words, the light distribution member 3 is designed to prevent parts of the light distribution member 3 other than the flange 3*b* from contacting the main body 2 when the light distribution member 3 is fastened to the main body 2. Thereby, the peripheral part of the board 4 can be securely brought into close contact with the thermal conduction surface 2*b* of the main body 2.

In addition, like the present embodiment, when the flange 3*b* is fastened to the main body 2 in a state where the peripheral part of the board 4 is held between the thermal conduction surface 2*b* of the main body 2 and the flange 3*b* of the light distribution member 3, since the attaching screws 8 do not directly act on the board 4, stress caused by heat of the board 4 can be released even when the board 4 expands by heat. Specifically, although the board 4 slightly expands by heat when the LEDs 10 mounted on the front surface of the board 4 generate heat by lighting, it is possible to prevent the board 4 from being bent and deformed by thermal stress.

In addition, to bring the back surface of the board 4 into closer contact with the thermal conduction surface 2*b* of the main body 2, a fastening structure of fixing the reflector 5 to the main body 2 is worked out in the present embodiment.

Specifically, in the present embodiment, a screw hole 5*a* (see FIGS. 1 and 11) into which an attaching screw 9 (another fastening member) is screwed is formed in the center part on the back surface side of the reflector 5. In addition, the attaching screw 9 is inserted from the back surface side of the main body 2, through the screw hole 2*e* which pierces through the center part of the thermal conduction surface 2*b* of the main body 2 and the screw hole 4*d* which pierces through the center part of the board 4, and screwed into the screw hole 5*a* located on the back surface side of the reflector 5 positioned on the front surface side of the board 4.

When the attaching screw 9 screwed as described above is screwed and fastened into the screw hole 5*a* of the reflector 5, the reflector 5 is pulled in a direction (upward in FIG. 11) going toward the thermal conduction surface 2*b* of the main body 2, and the center part of the board 4 is pressed from both sides between the thermal conduction surface 2*b* and the back surface of the reflector 5. In this state, the fastening force of the attaching screw 9 serves as pressing force by which the reflector 5 pushes the center part of the board 4 toward the thermal conduction surface 2*b*.

Thereby, the back surface of the board 4 is pushed, around the center part thereof, against the thermal conduction surface 2*b* of the main body 2, the back surface of the board 4 is brought, around the center part thereof, into close contact with the thermal conduction surface 2*b* in good state, and heat of the center part of the board 4 can be efficiently conducted to the thermal conduction surface 2*b*. Simultaneously, the back surface of the reflector 5 is also pushed against the front surface of the board 4, and thus radiation of heat of the board 4 can be performed through the reflector 5.

Besides, in particular, a rib 5*b* which projects from the back surface of the reflector 5 abuts against the front surface of the board 4, and presses the front surface of the board 4. Since the reflector 5 also effectively pushes rib 5*b* against the board 4 like this by fastening of the attaching screw 9, the reflector 5 is designed to have a shape by which parts other than the rib 5*b* do not contact the board 4 or the other peripheral members.

In addition, since the attaching screw 9 does not directly fasten or fix the board 4 to the thermal conduction surface 2*b*, like the attaching screws 8, the attaching screw 9 function to prevent deformation of the board 4 due to thermal stress when the board 4 expands by heat generated from the LEDs 10.

As described above, heat which is effectively conducted to the thermal conduction surface 2*b* through the peripheral part and the center part of the board 4 is radiated into the atmosphere through the heat-radiation fins 2*a* while the heat is conducted through the main body 2. Specifically, according to the present embodiment, it is possible to effectively cool the LEDs 10 mounted on the front surface of the board 4.

Figure 13:
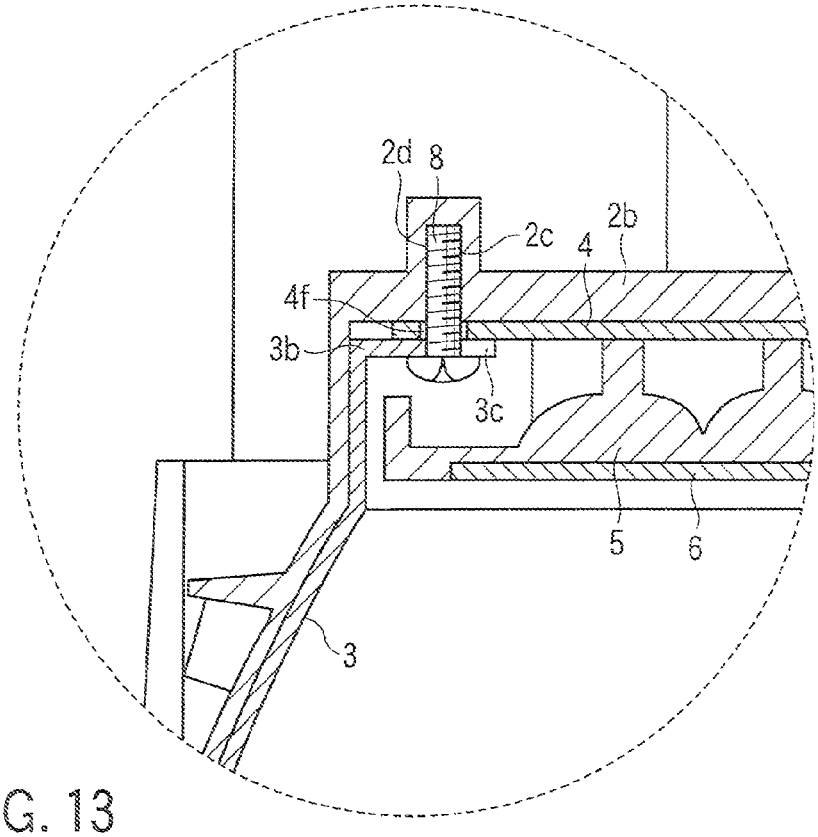
FIG. 13 is a partial enlarged cross-sectional view illustrating a modification of the structure of FIG. 11.

FIG. 13 illustrates a modification of the above embodiment.

A downlight of the modification has almost the same structure as that of the above embodiment, except for the point that three screw holes 4*f*, through which three respective attaching screws 8 are inserted, are formed in a peripheral part of a board 4, instead of three cut-away parts 4*c* formed in the peripheral part of the board 4.

The board 4 according to the modification is attached to the main body 2, with three projections 2*c* of a thermal conduction surface 2*b* of a main body 2 used as guides. When the board 4 is attached, the three screw holes 4*f* are superposed on the three respective screw holes 2*d* of the thermal conduction surface 2*b*. Therefore, the modification can also produce an effect similar to that of the above embodiment.

Figure 14:
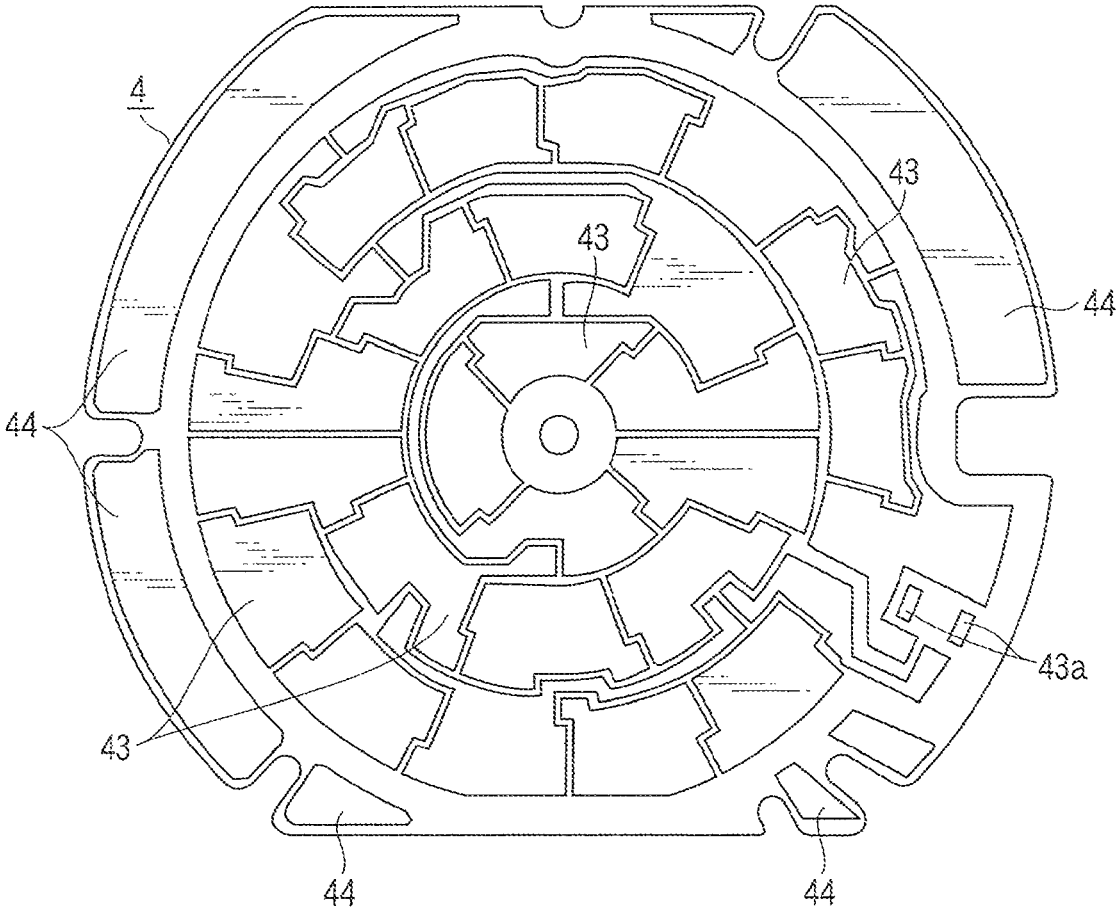
FIG. 14 is a schematic diagram illustrating a copper foil pattern of the board of FIG. 6.
Figure 15:
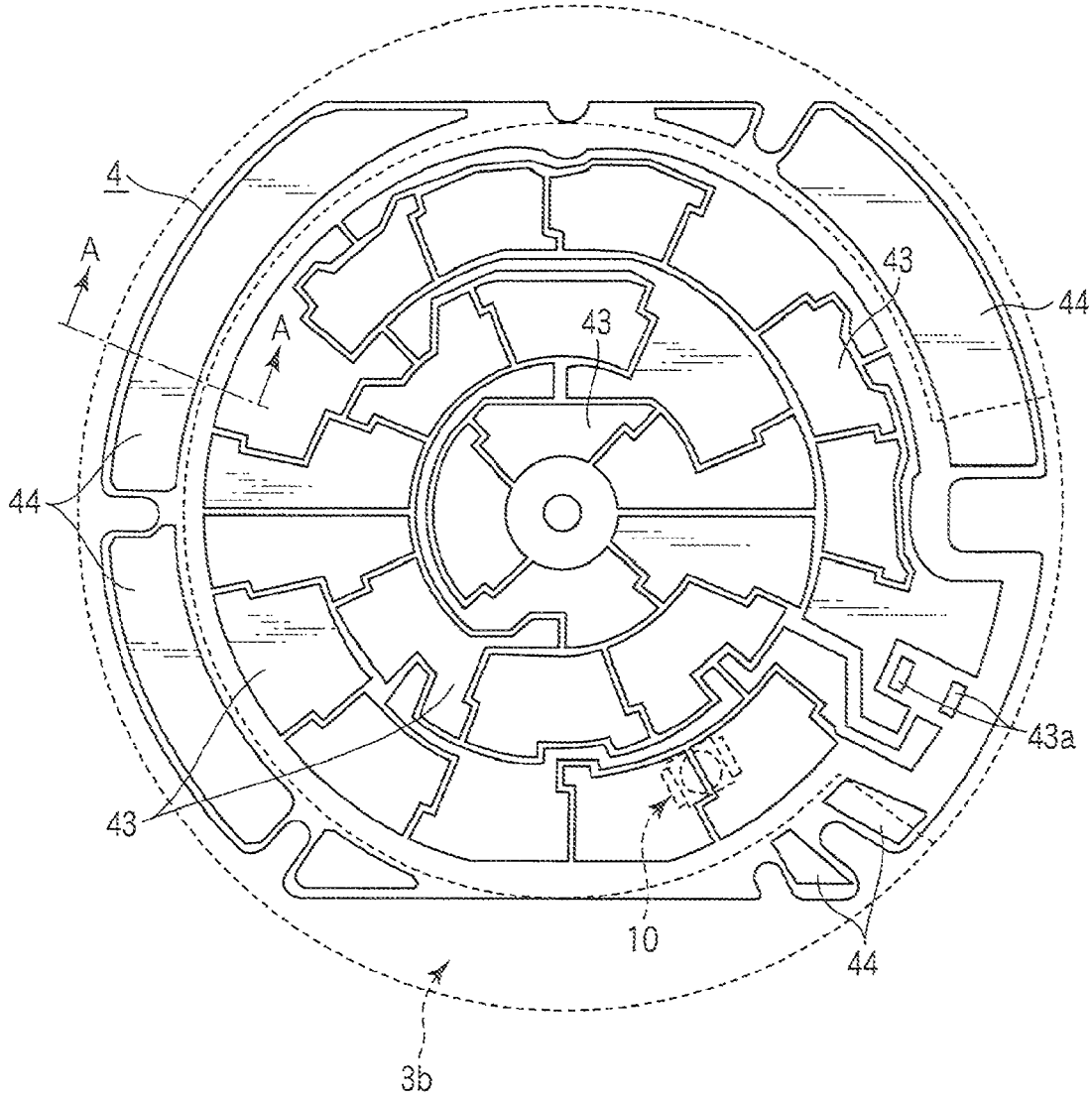
FIG. 15 is a schematic diagram for explaining positional relation between the copper foil pattern of FIG. 14 and a flange of the light distribution member.
Figure 16:
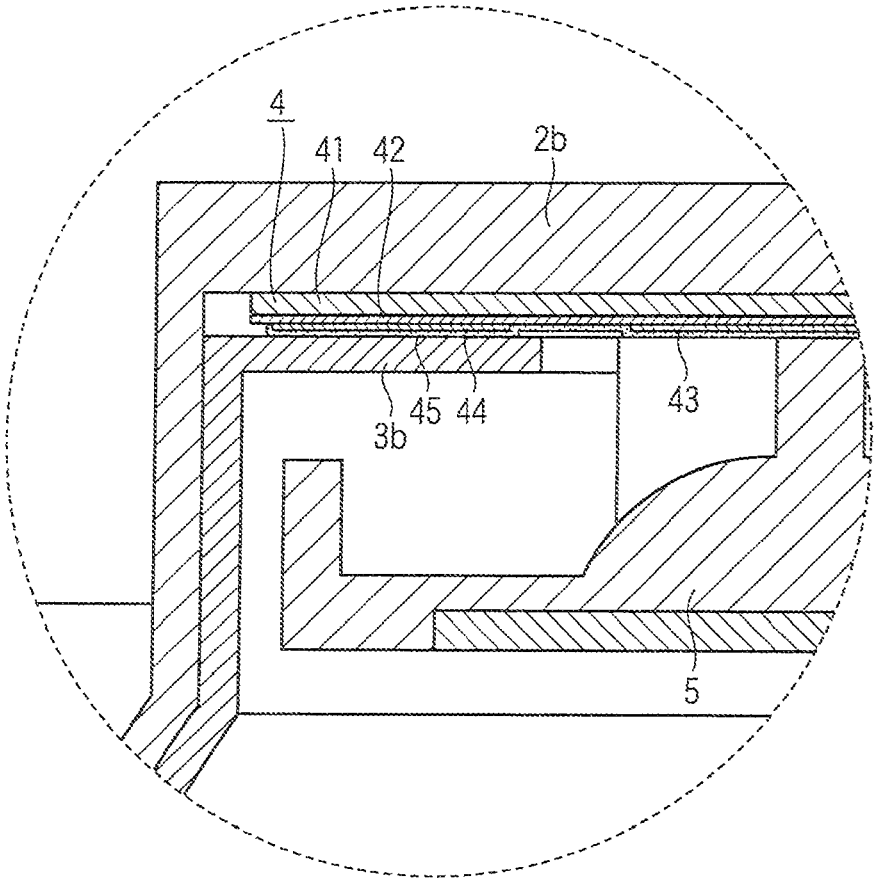
FIG. 16 is a partial enlarged cross-sectional view in which a part including a peripheral portion of the board having the copper foil pattern of FIG. 14 is enlarged.

The following is more detailed explanation of a structure of the above board 4, in particular, a structure for heat radiation of the board 4, with reference to FIGS. 14 to 16.

FIG. 14 illustrates a copper foil pattern of the board 4, FIG. 15 illustrates positional relation between the copper foil pattern of FIG. 14 and the flange 3*b* (indicated by broken lines) of the light distribution member 3 disposed opposite to the front surface of the board 4, and FIG. 16 is a partially enlarged cross-sectional view of the downlight 1, in which a part of the board 4 close to the peripheral part thereof is enlarged.

As illustrated in FIG. 16, the board 4 includes a base plate 41 formed of aluminum on the back surface side. An insulating layer 42 is superposed on a front surface of the base plate 41, and a copper foil pattern is formed on a front surface of the insulating layer 42. The copper foil pattern includes a wiring pattern layer 43 which connects the LEDs 10, and a heat conduction pattern layer 44. The wiring pattern layer 43 and the heat conduction pattern layer 44 are simultaneously formed by etching. A resist layer 45 is formed on the front surface side of the copper foil patterns 43 and 44. The resist layer 45 may be omitted.

As illustrated in FIG. 14, the wiring pattern layer 43 and the heat conduction pattern layer 44 are formed in an area which fills almost the whole surface of the board 4.

The wiring pattern layer 43 is divided into a plurality of blocks in accordance with the number of the LEDs 10 mounted on the board 4. The blocks are arranged together in an almost circular shape in the center of the board 4. The wiring pattern layer 43 also has a function as a heat spreader which diffuses head generated from the LEDs 10. Therefore, respective areas of the blocks are determined such that temperature distribution of the board 4 is almost uniform when heat is conducted from the LEDs 10. A terminal pattern 43*a* to connect an electricity-receiving connector 4*a* is formed to project outside from the circular area of the wiring pattern layer 43.

The heat conduction pattern layer 44 is formed apart from and outside the wiring pattern layer 43, and along the peripheral part of the board 4. The heat conduction pattern layer 44 is formed clear of the above terminal pattern 43*a*. Specifically, the heat conduction pattern layer 44 is electrically insulated from the wiring pattern layer 43 and the terminal pattern 43*a*. In the present embodiment, an insulating distance of at least 6.5 mm is kept between the heat conduction pattern layer 44 and the wiring pattern layer 43 (including the terminal pattern 43*a*). Specifically, the wiring pattern layer 43 is electrically conducted to the LEDs 10, while the heat conduction pattern layer 44 is not electrically conducted to the LEDs 10.

The flange 3*b* of the light distribution member 3 overlaps the heat conduction pattern layer 44, as indicated by broken lines in FIG. 15. In other words, when the light distribution member 3 is attached to the main body 2 with the board 4 held therebetween, the flange 3*b* of the light distribution member 3 is opposed to the heat conduction pattern layer 44, and contacts the front surface of the board 4. In other words, in the present embodiment, the heat conduction pattern layer 44 is formed in a position overlapping the flange 3*b* when the light distribution member 3 is attached. FIG. 15 illustrates one LED 10 with broken lines as an example. As described above, each LED 10 is connected to extend over blocks of the wiring pattern layer 43.

The following is explanation of a route to transmit heat generated by the LEDs 10.

When electric power is supplied from the power supply circuit 21 to the board 4 through the electricity-receiving connector 4*a*, the LEDs 10 mounted on the front surface of the board 4 are supplied with electric power and emit light. Light outgoing from the LEDs 10 directly passes through the cover 6, or passes through the cover 6 after being reflected once by reflection surfaces 5*f* of the reflector 5, and is used as illumination light after distribution control by the light distribution member 3. When the downlight 1 is lit, the LEDs 10 are heated as time goes by.

Most of heat generated by the LEDs 10 is mainly transmitted from the back surface side of the board 4 to the thermal conduction surface 2*b* of the main body 2. During the transmission, the heat is diffused through the wiring pattern layer 43 of the board 4 to which the LEDs 10 are connected, and the whole board 4 is uniformly heated. Then, the heat diffused by the wiring pattern layer 43 is effectively conducted to the aluminum base plate 41 on the back surface side of the board 4, and the heat is conducted to the thermal conduction surface 2*b* of the main body 2, which contacts the base plate 41.

In the present embodiment, the peripheral part of the board 4 is pushed against the thermal conduction surface 2*b* by fastening the flange 3*b* of the light distribution member 3 to the thermal conduction surface 2*b* of the main body 2, and the back surface of the board 4 is brought, in the peripheral part thereof, into close contact with the thermal conduction surface 2*b*. In addition, in the present embodiment, the center part of the board 4 is pushed against the thermal conduction surface 2*b* by fastening the reflector 5 to the main body 2, and the back surface of the board 4 is brought, in the center part thereof, into close contact with the thermal conduction surface 2*b*. Specifically, in the present embodiment, since the whole back surface of the board 4 is brought into close contact with the thermal conduction surface 2*b* of the main body 2, heat of the board 4 can efficiently be conducted to the thermal conduction surface 2*b* of the main body 2.

The heat conducted to the thermal conduction surface 2*b* is conducted to the whole main body 2 to end parts thereof, and radiated into the atmosphere through heat radiation fins 2*a* provided on the external surface of the main body 2, while the heat is conducted through the main body 2.

On the other hand, part of the heat generated by the LEDs 10 is conducted from the front surface side of the board 4 to the flange 3*b* of the light distribution member 3. Specifically, after heat of the LEDs 10 is diffused into the wiring pattern layer 43 and conducted to the base plate 41, part of the heat is conducted to the heat conduction pattern layer 44 on the front surface side of the board 4 through the insulating layer 42. Then, the heat conducted to the heat conduction pattern layer 44 is conducted to the light distribution member 3 through the flange 3*b* opposed to the heat conduction pattern layer 44.

According to the present embodiment, since the peripheral part of the board 4 is pushed against the thermal conduction surface 2*b* by the flange 3*b* by fastening the light distribution member 3 to the main body 2, the upper surface of the flange 3*b* is brought into close contact with the peripheral part on the front surface side of the board 4 in good state. Therefore, the heat conduction pattern layer 44 disposed in the peripheral part of the board 4 is thermally connected to the flange 3*b*, and heat of the heat conduction pattern layer 44 can be efficiently conducted to the light distribution member 3.

In addition, heat conducted through the flange 3*b* is conducted through the light distribution member 3 formed of metal material having good thermal conductivity, and effectively radiated from the front surface side of the downlight 1. In radiation, since the light distribution member 3 has the inclined part which spreads downward toward the outside and the flange 3*a* of the larger-diameter side as one unitary piece, the light distribution member 3 has a relatively wide area exposed to the air, and can perform effective heat radiation.

Besides, part of heat of the board 4 is radiated through the reflector 5 disposed in contact with the front surface of the board 4. In the present embodiment, the back surface of the reflector 5 is brought into close contact with the front surface of the board 4 by fastening the reflector 5 to the thermal conduction surface 2*b* of the main body 2, and thus heat conduction efficiency can be improved.

Lastly, the effect of the embodiment described above is explained.

According to the present embodiment, the back surface of the board 4 is brought, in the peripheral part and the center part thereof, into close contact in good state with the thermal conduction surface 2*b* of the main body 2, and thus heat of the board 4 can be efficiently conducted to the main body 2, and the cooling efficiency of the LEDs 10 can be improved. In this case, since the board 4 is not directly fastened or fixed to the thermal conduction surface 2*b* of the main body 2, there is no fear that the board 4 may be distorted by thermal stress, even when the board 4 expands by heat. Specifically, according to the present embodiment, even when the board 4 repeatedly expands and contracts by heat, the stress can be released, and it is possible to prevent the board 4 from warping and deforming due to heat, and suppress generation of cracks in a solder part (not shown) or the like.

In addition, according to the present embodiment, since the board 4 is not directly fastened to the main body 2 by screws or the like, the number of screws can be reduced for that, and it is possible to reduce the number of parts and the manufacturing cost. Besides, in this case, the step for fastening and fixing the board 4 alone is unnecessary, and thus it is possible to simplify the assembly process of the downlight 1 for that, and reduce the working cost for assembly. In addition, since the board 4 is brought into close contact with the thermal conduction surface 2*b* of the main body 2, it is possible to perform, from the front surface side of the light distribution member 3, the work of fastening the flange 3*b* of the light distribution member 3 to the thermal conduction surface 2*b*, and improve the workability.

Besides, according to the present embodiment, when the board 4, the light distribution member 3, and the reflector 5 are attached in a superposed state to the thermal conduction surface 2*b* of the main body 2, the three projections 2*c* projecting from the thermal conduction surface 2*b* are used as guides. Therefore, the members 3, 4 and 5 can be easily attached in accurate orientation at accurate attaching angle, and erroneous attachment in erroneous orientation can be prevented. In addition, in this case, it is unnecessary for the worker to check the orientation of the members 3, 4 and 5, and it is possible to securely and easily perform the assembly work. In particular, the positioning projections 2*c* can also be used for not only positioning of the board 4 but also positioning of the light distribution member 3 and the reflector 5, one set of projections 2*c* can be used in common to the three members, and the structure of the downlight can be simplified for that.

In addition, according to the present embodiment, the light distribution member 3 is fastened and fixed to the main body 2, and thereby the flange 3*b* of the light distribution member 3 can be brought into close contact with the peripheral part on the front surface side of the board 4, and heat of the LEDs 10 can be effectively radiated also from the front surface side of the board 4. In particular, in this case, since the light distribution member 3 serving as heat radiation member has a relatively wide area exposed to the air, the heat radiation effect can be improved. Besides, according to the present embodiment, since the part of the board 4, to which the flange 3*b* of the light distribution member 3 is opposed, is provided with the heat conduction pattern layer 44, heat which is diffused in the wiring pattern layer 43 and conducted to the base plate 41 can be efficiently conducted to the light distribution member 3 through the heat conduction pattern layer 44, and heat radiation efficiency can be improved.

As described above, according to the present embodiment, it is possible to take sufficient and secure heat radiation measures for the LEDs 10.

Figure 17:
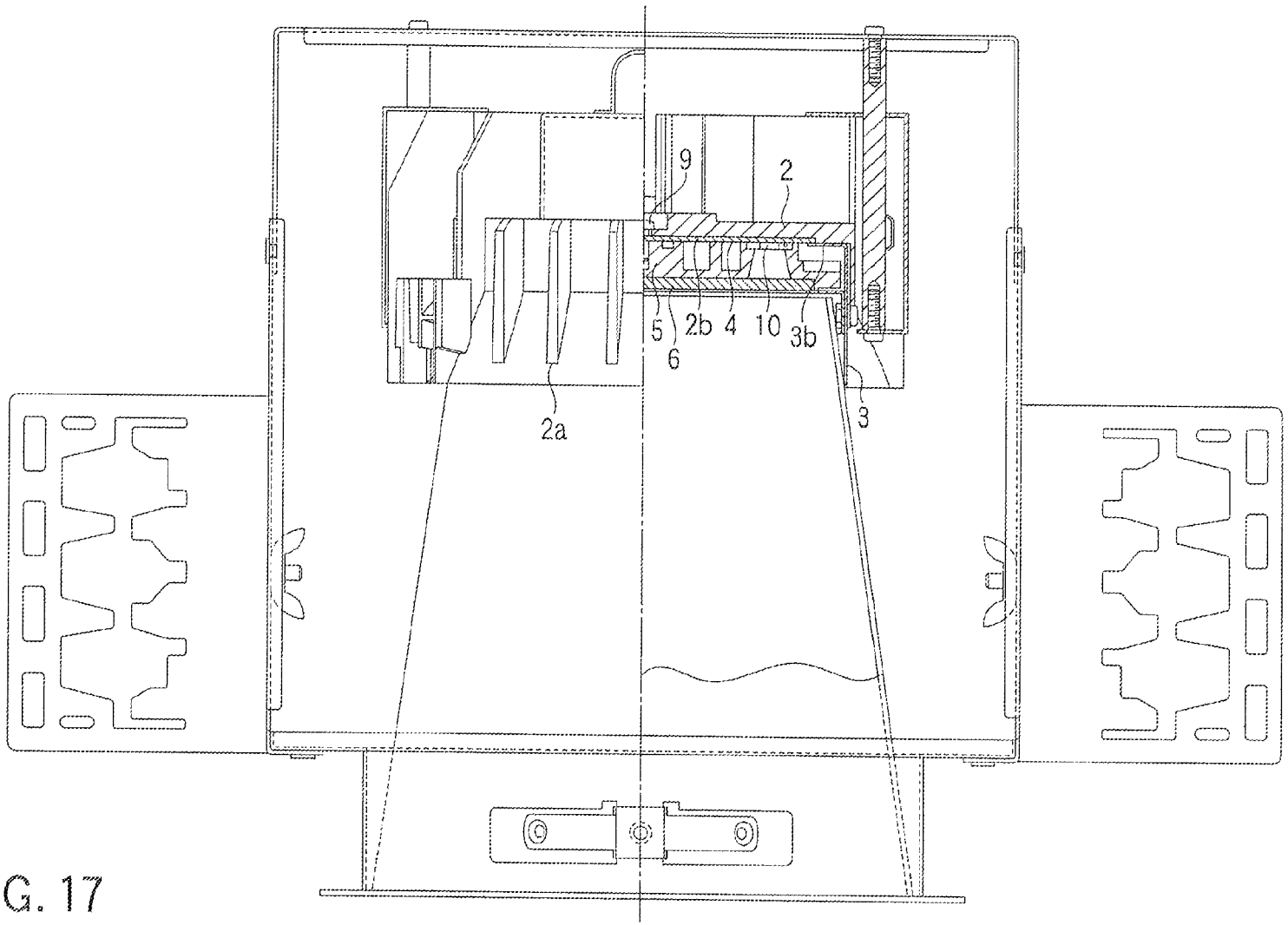
FIG. 17 is a schematic diagram illustrating a main part of a downlight according to another embodiment.

FIG. 17 is a schematic diagram of a main part of a downlight 1 according to another embodiment.

The downlight 1 has almost the same function as that of the downlight 1 of the above embodiment, although it is different in design. Therefore, constituent elements which function in the same manner as in the downlight 1 of the above embodiment are denoted by the same respective reference numerals as those of the above embodiment.

Specifically, the downlight 1 also includes a holding member 3 which pushes a peripheral part of a board 4 to a thermal conduction surface 2*b*, to bring a back surface of the board 4 into close contact with the thermal conduction surface 2*b* of a main body 2. The holding member 3 includes an almost ring-shaped flange 3*b* to push the peripheral part of the board 4 to the thermal conduction surface 2*b* of the main body 2.

In addition, a reflector 5 disposed on the front surface side of the board 4 is fastened and fixed to the main body 2, by an attaching screw 9 which is inserted through a center part of the main body 2 and a center part of the reflector 5.

Therefore, also in the present embodiment, the back surface of the board 4 can be brought into close contact with the thermal conduction surface 2*b* of the main body 2 in good state, in the peripheral part and the center part of the board 4, and the same effect as that of the above embodiment can be produced.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, although the above embodiments show the light distribution member 3 and the holding member 3 as examples of optical member which holds the peripheral part of the board 4 together with the main body 2, the invention is not limited to them, but it is possible to use the reflector 5 as the holding member. In this case, the peripheral part of the reflector 5 should be pushed against the peripheral part of the board 4 to hold the peripheral part of the board 4 between the reflector 5 and the thermal conduction surface 2*b*.

In addition, although the above embodiment show the three projections 2*c* projecting from the thermal conduction surface 2*b* as example of means for positioning the board 4, the light distribution member 3, and the reflector 5 with respect to the main body 2, the invention is not limited to them, but cut-away parts and through holes may be used instead.

Besides, other circuit parts may be mounted on the front surface of the board 4, in addition to the LEDs 10. In such a case, for example, a capacitor to prevent erroneous lighting of the LEDs 10 due to overlapping of noise with the lighting circuit may be mounted on the front surface of the board 4.

In addition, the shape of the board 4 is not limited to a circular shape, but may be a rectangular, polygonal, elliptic, or oval shape.

Besides, although the above embodiments show the structure in which the light distribution member 3 is fastened at three positions to the thermal conduction surface 2*b* with the peripheral part of the board 4 held therebetween, the invention is not limited to the structure, but the fastening positions may be a plurality of positions being at least two positions.

What is claimed is:

1. A lighting apparatus comprising:

a main body which includes a flat thermal conduction surface;

a board which includes a front surface on which a light-emitting device is mounted, and a back surface that contacts the thermal conduction surface;

an optical member which includes an annular inner edge part, a peripheral part of the board being interposed between the thermal conduction surface and the inner edge part, the optical member also including an annular inclined surface expanding outward from the inner edge part, and reflects, on the inclined surface, light emitted from the light-emitting device; and a fastening member which fastens the inner edge part of the optical member to the main body, such that the back surface of the board is pushed, in the peripheral part of the board, against the thermal conduction surface.

2. The lighting apparatus according to claim 1, wherein the fastening member is disposed in a plurality of positions apart from each other along the peripheral part of the board.

3. The lighting apparatus according to claim 2, further comprising:

a reflector which is disposed opposite to a center part of the board on the front surface side of the board, and includes a reflection surface which reflects light of the light-emitting device; and another fastening member which fastens the reflector to the main body, such that the back surface of the board is pushed, in the center part of the board, against the thermal conduction surface.

4. The lighting apparatus according to claim 2, wherein the optical member is a cylindrical light distribution member which is disposed to surround the light-emitting device and distribute and control light from the light-emitting device.

5. The lighting apparatus according to claim 4, wherein the light distribution member is formed of material having thermal conductivity.

6. The lighting apparatus according to claim 1, further comprising:

a positioning projection projecting from the thermal conduction surface, wherein the board includes a first receiving part which receives the projection and thereby positions the board with respect to the thermal conduction surface, and the optical member includes a second receiving part which receives the projection and thereby positions the optical member with respect to the thermal conduction surface in a state where the optical member is brought into contact with the front surface of the board.

7. The lighting apparatus according to claim 1, wherein the board includes a wiring pattern layer which is electrically connected to the light-emitting device, and a heat conduction pattern layer which is apart from the wiring pattern layer, and the optical member is opposed and thermally connected to the heat conduction pattern layer.

8. The lighting apparatus according to claim 7, wherein the optical member is a cylindrical light distribution member which is disposed to surround the light-emitting device and control and distribute light from the light-emitting device.

9. The lighting apparatus according to claim 8, wherein the light distribution member is formed of material having thermal conductivity.

* * * * *